US011652299B2

(12) United States Patent
Livadaru et al.

(10) Patent No.: US 11,652,299 B2
(45) Date of Patent: May 16, 2023

(54) WIDEBAND DIPOLE ARRAY WITH DIFFERENTIAL FEEDING

(71) Applicant: BAE Systems Information and Electronic Systems Integration Inc., Nashua, NH (US)

(72) Inventors: Matilda Livadaru, Bedford, NH (US); Mark Fosberry, Groton, MA (US); James F. Fung, Manchester, NH (US); Alexander D. Johnson, Waltham, MA (US); Randall R. Lapierre, Hooksett, NH (US); Daniel G. Morin, Salem, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 14 days.

(21) Appl. No.: 17/184,985

(22) Filed: Feb. 25, 2021

(65) Prior Publication Data

US 2022/0271438 A1 Aug. 25, 2022

(51) Int. Cl.

| | |
|---|---|
| ***H01Q 21/06*** | (2006.01) |
| ***H01Q 21/26*** | (2006.01) |
| ***H01Q 9/28*** | (2006.01) |

(52) U.S. Cl.

CPC ..... *H01Q 21/062* (2013.01); *H01Q 9/285* (2013.01); *H01Q 21/26* (2013.01)

(58) Field of Classification Search

CPC ..... H01Q 9/18; H01Q 21/062; H01Q 21/26

See application file for complete search history.

(56) References Cited

U.S. PATENT DOCUMENTS

| | | | | |
|---|---|---|---|---|
| 9,865,934 | B2 | 1/2018 | Sertel et al. | |
| 9,991,605 | B2 | 6/2018 | Elsallal et al. | |
| 10,320,088 | B1 | 6/2019 | Johnson et al. | |
| 2014/0009356 | A1 | 1/2014 | Sertel et al. | |
| 2018/0040955 | A1* | 2/2018 | Vouvakis ..... | H01Q 9/065 |
| 2020/0014121 | A1* | 1/2020 | Maccabe ..... | H01Q 15/24 |
| 2022/0173507 | A1* | 6/2022 | Varnoosfaderani ..... | H01Q 21/062 |

OTHER PUBLICATIONS

J. R. Bayard, et. al, "E-plane scan performance of infinite arrays of dipoles printed on protruding dielectric substrates: coplanar feed line and E-plane metallic wall effects," IEEE TAP., vol. 41, No. 6, pp. 837-841, Jun. 1993.

(Continued)

*Primary Examiner* — Andrea Lindgren Baltzell
*Assistant Examiner* — Amal Patel
(74) *Attorney, Agent, or Firm* — Sand, Sebolt & Wernow LPA; Scott J. Asmus; Gary McFaline

(57) ABSTRACT

A tightly coupled dipole array is an egg-crate configuration defined by a plurality of electrically connected antenna unit cells. At least one of the unit cells utilizes a short or conductive element that shorts the common mode resonance. Shorting the common mode resonance in an intentional manner removes instances of the common mode resonance. To achieve the shorting of the common mode resonance, a conductive element is connected with one of the dipole arms and connected to the outer conductor of the feed or a ground plane. This creates a grounding loop that pushes the resonance out of the band of interest.

10 Claims, 7 Drawing Sheets

(56) References Cited

OTHER PUBLICATIONS

J. J. Lee, et. al, "Performance of a wideband (3-14GHz) dual-pol array," IEEE APS Conf., vol. 1, pp. 551-554, Jun. 2004.
E. de Lera Acedo, et. al, "Study and design of a differentially-fed tapered slot antenna array," IEEE TAP., vol. 58, No. 1, pp. 68-78, Jan. 2010.
S. Holland, et. al, "The planer ultrawideband modular antenna (PUMA) array," IEEE TAP., vol. 60, No. 1, pp. 130-140, Jan. 2012.
S. Holland, et. al, "A 7-21 GHz dual-polarized planar ultrawideband modular antenna (PUMA) array," IEEE TAP., vol. 30, No. 10, pp. 4589-4600, Oct. 2012.
J. Doane, et. al, "A wideband, wide scanning tightly coupled dipole array with integrated balun (TCBA-IB)," IEEE TAP., vol. 61, No. 9, pp. 4538-4548, Sep. 2013.
M. Wajih Elsallal, et. al, "Development of substrate-fee frequency-scaled ultra-wide spectrum element (FUSE) phased array," IEEE, Jul. 2016.
A. O. Bah, et. al, "An extremely wideband tapered balun for application in tightly coupled arrays," IEEE-APS Topical Conference on Antennas and Propagation in Wireless Communications (APWC), Cairns, QLD, Australia, 2016, pp. 162-165.
S. Kim, et. al, "Design of TCDA Avoiding Half-wavelength Limitation Using PC," 2020 14th European Conference on Antennas and Propagation (EuCAP), Copenhagen, Denmark, 2020, pp. 1-4.

* cited by examiner

WIDEBAND DIPOLE ARRAY WITH DIFFERENTIAL FEEDING

TECHNICAL FIELD

Examples in the present disclosure relate to a balanced feed for an antenna element with integrated common-mode rejection realized in printed circuit board (PCB) technology. This approach extends the bandwidth of the aperture. The feeding structure is applied to phase-coincident dual-polarized (horizontal and vertical), offset dual-pol apertures, or single polarized (linear pol) apertures.

BACKGROUND

Wide band antennas and arrays are essential for high-resolution radar and tracking systems, high data rate communication links, and multi-waveform, multi-function front ends. Various array technologies have been developed that are capable of extremely wide bandwidth (up to 10:1 or more). However, many existing designs are limited by their electrical thickness, scanning performance, or use of lossy materials. Tightly coupled dipole arrays (TCDAs) are low profile and efficient with wide bandwidth, good scan performance, and low cross polarization.

TCDAs have demonstrated large impedance bandwidths and scanning performance in a low profile of ($\lambda_{High}/2$). These ultra-wide bandwidth (UWB) arrays are extensions of the Current Sheet Array (CSA) concept. The first CSAs achieved 4:1 bandwidth by introducing capacitive coupling between antenna elements to counter the effect of ground plane inductance. Additional bandwidth was later achieved by introducing integrated wideband printed balun feeds to be optimized along with the dipole elements. Such TCDA with integrated feeds have been demonstrated to extend bandwidths, reduce size by more than half, and cut weight by a factor of 5, all with an order of magnitude cost reduction. Further optimizations of the TCDA were addressed to increase impedance bandwidths up to 20:1 via substrate loading, scan down to 75° through Frequency Selective Surface (FSS) superstrates, and operate at millimeter-wave frequencies. As a result, TCDAs were designed from 300 MHz up to 90 GHz with VSWR<3.

These types of TCDAs employ wideband single-ended (unbalanced) feeds, but these feeds are not suited for the direct chip integration required for 5G applications. The latter is important as future integrated transceivers are likely to be differential to accompany the balanced transmission lines on the RF side of the chips. The major challenge in the design of a full differential radio is the reduction of the common mode currents that can exist at the aperture and in between the ports that feed the aperture. These common mode currents can greatly reduce the impedance bandwidth. Indeed, differential feeds have been proposed in the past, but they are narrowband with limited scanning capability. Therefore, most past arrays have employed only single-ended feeds to achieve wideband scanning. However, these single-ended feeds suffer from distortions introduced by noise from common-mode, power supplies, or general electromagnetic interference (EMI), drastically affecting antenna performance. One exemplary TCDA that was designed to overcome these challenges is taught in U.S. Pat. No. 10,320,088.

A notable technique is to use unbalanced feeds with shorting posts to mitigate common mode resonances, resulting in 5:1 bandwidth after external impedance matching has been discussed as a Planar Ultrawideband Modular Antenna (PUMA) Array. The PUMA Array is fabricated with planar etched circuits and plated vias, thus it can be fabricated as a multilayer microwave PCB, and does not require external baluns. The PUMA array consists of a dual-offset dual-polarized version of tightly-coupled dipoles above a ground plane, fed by unbalanced feed-line scheme. The PUMA Array has shorting vias at its dipole arms, enabling direct connection to standard RF interfaces and modular construction. The placement of the plated vias controls the frequency of a catastrophic common mode that would otherwise occur near mid-band since the array is fed unbalanced.

In the PUMA Array, the dipole elements, ground plane, and dielectric layers provide wideband performance, based upon the current sheet principle. However, the feed and dipole arrangements of the PUMA array are unique inasmuch as it requires the unbalanced feed. The unbalanced feed lines are utilized without exciting the catastrophic common-mode resonance found in 2D unbalanced fed arrays. More importantly, this feeding method avoids "cable organizers," since the unbalanced feed lines do not support the scan-induced common-modes typical of balanced fed arrays. This allows the entire PUMA Array (radiating elements and feed lines) to be fabricated as a single microwave multilayer PCB, with the feed lines and shorting posts implemented as plated vias. Also, the unbalanced feed lines in the PUMA Array connect to standard 50Ω interfaces (coax, stripline, microstrip, CPW, etc.) without an external balun. An additional advantage derived from the unbalanced feed arrangement and the dual-offset, dual-polarized offset (egg-crate) lattice is modularity. As PUMA array modules can be formed by intersecting planes passing between the feed line vias, therefore a PUMA Array can be built and assembled modularly.

SUMMARY

Although the aforementioned PUMA Array has some advantages, there still exists a need for a TCDA that does not use balun. One particular need exists when differential signals (i.e., balanced) signals are fed/input into the antenna. This need has arisen inasmuch as the PUMA Array requires unbalanced feeds/inputs. Particularly, there exists a need to overcome the design of the PUMA Array, which is a single-ended planar TCDA with shorted dipole arms and 3:1 Bandwidth ratio. The present disclosure addresses this need by providing a differential (i.e., balanced) feed egg-crate TCDA with shorted dipole arms and an achievable 9:1 Bandwidth ratio.

The present disclosure also relates generally to the configuration and operation of an antenna feed for a TCDA. Typically, TCDAs have high potential and have a high bandwidth potential. However, to meet that potential, there needs to be a feed that is able to excite the antenna across its bandwidth and match impedance with low losses and high efficiency. During operation of a TCDA, each antenna element is a dipole. A dipole is inherently differential, which means it has a positive and a negative.

Operatively, TCDAs are wideband antennas that cover many frequencies. This is advantageous for many applications because they can perform more than one function at one time with a single aperture. Because of this wideband feature, there must be a feed that is efficient to provide the power to the TCDA. First, power must be injected into the antenna. The feed injects the power in an efficient and wideband manner. An exemplary inventive concept in accordance with the present disclosure is how the feed of the present disclosure injects the power in an efficient and wideband manner.

During conventional operation, the dipole in a TCDA must be balanced. Each dipole therefor has a positive node and a negative node. The positive node and the negative node are referenced to each other. The dipoles may be fed in a variety of different ways. For example, previous teachings of the Tightly Coupled Dipole Array with Integrated Balun (TCDA-IB) utilized a Marchand balun to feed it from the single-ended input to the dipole's differential. The reason for this configuration will allow improved beam steering. Particularly, this configuration eliminates E-plane scan resonance. The use of the Marchand balun mitigates the E-plane resonance. However, there are some operative drawbacks with using this type of configuration. Namely, the use of the Marchand balun changes the nature of the signal so that it does not have a positive and a negative. The use of a Marchand balun results in a positive and a ground. The downside of this configuration is that it has a reduced performance and does not maintain linearity over the bandwidth (i.e. it is non-symmetric). The use of one balun often requires that additional baluns be added to the configuration later. However, TCDAs typically want to maintain differential but this requires the antenna system to account for common mode resonance. Thus, since it is advantageous to keep the differential, the present disclosure presents an operative configuration of a TCDA that has a differential feed but reduces or eliminates common mode resonance that are E-plane resonances that need to be mitigated. The existence of common mode resonance reduces the scanning ability of the TCDA; thus, it is advantageous to reduce the common mode resonance so as to maintain the scanning capabilities of the TCDA.

In accordance with an aspect of the present disclosure, the TCDA of the present disclosure takes advantage of a simple twin line configuration with a new feed configuration for the simple twin line. This allows the TCDA of the present disclosure to take advantages of the benefits of the differential of the twin lines without the problems that arise when using a balun. Since there is no balun in the TCDA of the present disclosure, it uses a differential or balanced feed to connect with the differential twin lines.

In accordance with an exemplary aspect of the present disclosure, one embodiment utilizes a short or conductive element that shorts the common mode resonance. Shorting the common mode resonance in an intentional manner removes instances of the common mode resonance. In a common mode, the phase of the input signals are facing the same direction. When the currents and phases are the same, it results in electromagnetic radiation. However, it is desirable to not have the feed become impeded by radiation in the feed. Thus, it is desirable to not have the feed line radiate and only transmit the power to the dipole elements. To achieve the shorting of the common mode resonance, a conductive element is connected with one of the dipole arms and connected to the outer conductor of the feed. This creates a loop that pushes the resonance out of the band of interest.

In one aspect, an exemplary embodiment of the present disclosure may provide an antenna unit cell, which is one of many similar unit cells that collectively define a TCDA, wherein the antenna unit cell comprises a differential feet input comprising a positive terminal and a negative terminal, wherein the positive terminal and the negative terminal are adapted to receive a differential signal, wherein the positive terminal is adapted to receive the differential signal at a first phase and the negative terminal is adapted to receive a second portion of the differential signal at a second phase that is opposite the first phase; a first feed line having a first end and a second end; a second feed line having a first end and a second end, wherein the first feed line and the second feed line define a pair of differential feed lines; the first end of the first feed line in electrical communication with the positive terminal; the first end of the second feed line in electrical communication with the negative terminal; a first dipole arm; a second dipole arm; the second end of the first feed line in electrical communication with the first dipole arm; the second end of the second feed line in electrical communication with the second dipole arm; a common ground plane; and a common mode mitigation element having a first end and a second end, and the first end of the common mode mitigation element in electrical communication with the first dipole arm and the second end of the common mode mitigation element in electrical communication with the common ground plane, wherein the common mode mitigation element is adapted to short the signal from the first dipole arm to the common ground plane to mitigate common mode in the antenna unit cell.

This embodiment of the exemplary antenna unit cell, or another exemplary embodiment may further provide wherein the common mode mitigation element includes: a first conductive line defining the first end of the common mode mitigation element, wherein at least a portion of the first conductive line is disposed below the first dipole arm. This embodiment of the exemplary antenna unit cell, or another exemplary embodiment may further provide a second conductive line defining the second end of the common mode mitigation element that is disposed below the first dipole arm. This embodiment of the exemplary antenna unit cell, or another exemplary embodiment may further provide wherein the first conductive line is in electrical communication with and physically oriented orthogonal to the second conductive line. This embodiment of the exemplary antenna unit cell, or another exemplary embodiment may further provide wherein the first conductive line is in electrical communication with the second conductive line, and a first feed shield formed from conductive material that is in electrical communication with the common ground plane, wherein the second end of the common mode mitigation element is in electrical communication with the feed shield.

This embodiment of the exemplary antenna unit cell, or another exemplary embodiment may further provide a substrate having a major outer first surface and a major outer second surface opposite the first surface, wherein the feed shield is coupled to the first surface. This embodiment of the exemplary antenna unit cell, or another exemplary embodiment may further provide at least one shielding via formed from a conductive material that is in electrical communication with the feed shield and the at least one shielding via extends through the substrate from the first surface to the second surface, wherein the second end of the common mode mitigation element is in electrical communication with the at least one shielding via. This embodiment of the exemplary antenna unit cell, or another exemplary embodiment may further provide a plurality of shielding vias formed from conductive material that is in electrical communication with the feed shield, wherein the at least one shielding via is one of the plurality of shielding vias, wherein the plurality of shield vias are linearly aligned in vertical orientation relative to the substrate. This embodiment of the exemplary antenna unit cell, or another exemplary embodiment may further provide a second feed shield formed from conductive material that is disposed on an opposite side of the substrate from the first feed shield, wherein second feed shield is in electrical communication with the ground plane and the plurality of shield vias are in electrical communication with the second feed shield.

This embodiment of the exemplary antenna unit cell, or another exemplary embodiment may further provide a shielding pad formed from conductive material in electrical communication with the at least one shielding via. This embodiment of the exemplary antenna unit cell, or another exemplary embodiment may further provide wherein the shielding pad surrounds a portion of the at least one shielding via. This embodiment of the exemplary antenna unit cell, or another exemplary embodiment may further provide an inner edge of the shielding pad having a configuration that is complementary to an outer surface of the at least one shielding via, wherein the shielding pad circumscribes the at least one shielding via. This embodiment of the exemplary antenna unit cell, or another exemplary embodiment may further provide wherein the shielding pad is disposed in the first surface of the substrate. This embodiment of the exemplary antenna unit cell, or another exemplary embodiment may further provide wherein the shielding pad is in electrical communication with the first feed shield that is connected to the first surface of the substrate. This embodiment of the exemplary antenna unit cell, or another exemplary embodiment may further provide a first portion of the first feed shield; a second portion of the first feed shield; wherein the second portion of the first feed shield is orthogonal to the first portion of the first feed shield; wherein first portion of the first feed shield directly abuts the first surface of the substrate and the second portion of the first feed shield is adapted to directly abut a second substrate carrying a second common mode mitigation element in electrical communication with the common ground plane.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
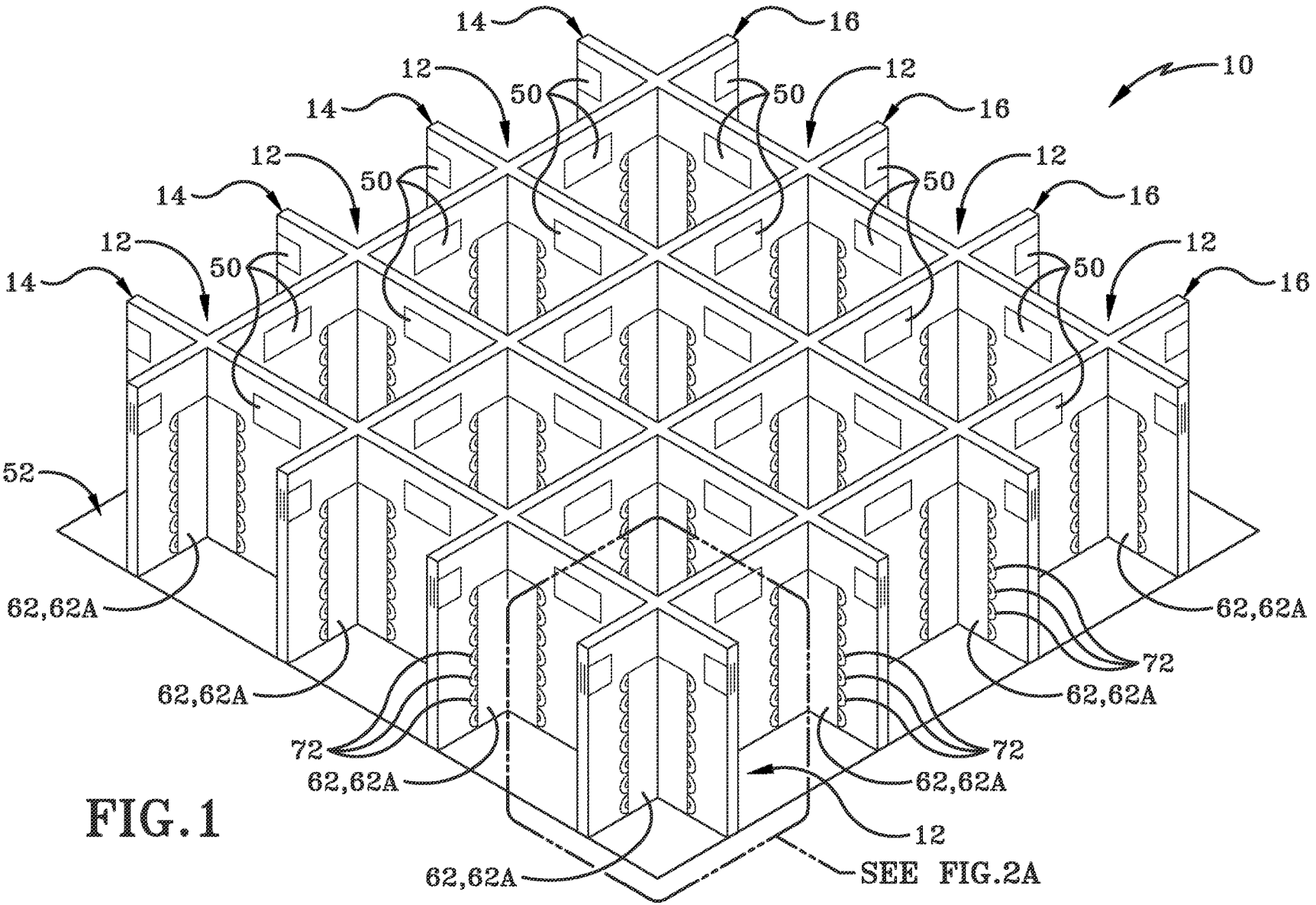
FIG. 1 is a top perspective view on an exemplary tightly coupled dipole array according to one aspect of the present disclosure.

FIG. 1 depicts an egg crate tightly coupled dipole array (TCDA) antenna generally at 10. TCDA antenna 10 includes a plurality of antenna unit cells 12 arranged in an egg crate configuration. Each unit cell 12 comprises a vertically polarized antenna element 14 and a horizontally polarized antenna element 16. Each antenna element 14, 16 may be largely fabricated as a printed circuit board (PCB). The PCB of the vertically polarized element 14 is orthogonal to the horizontally polarized element 16.

Figure 2A:
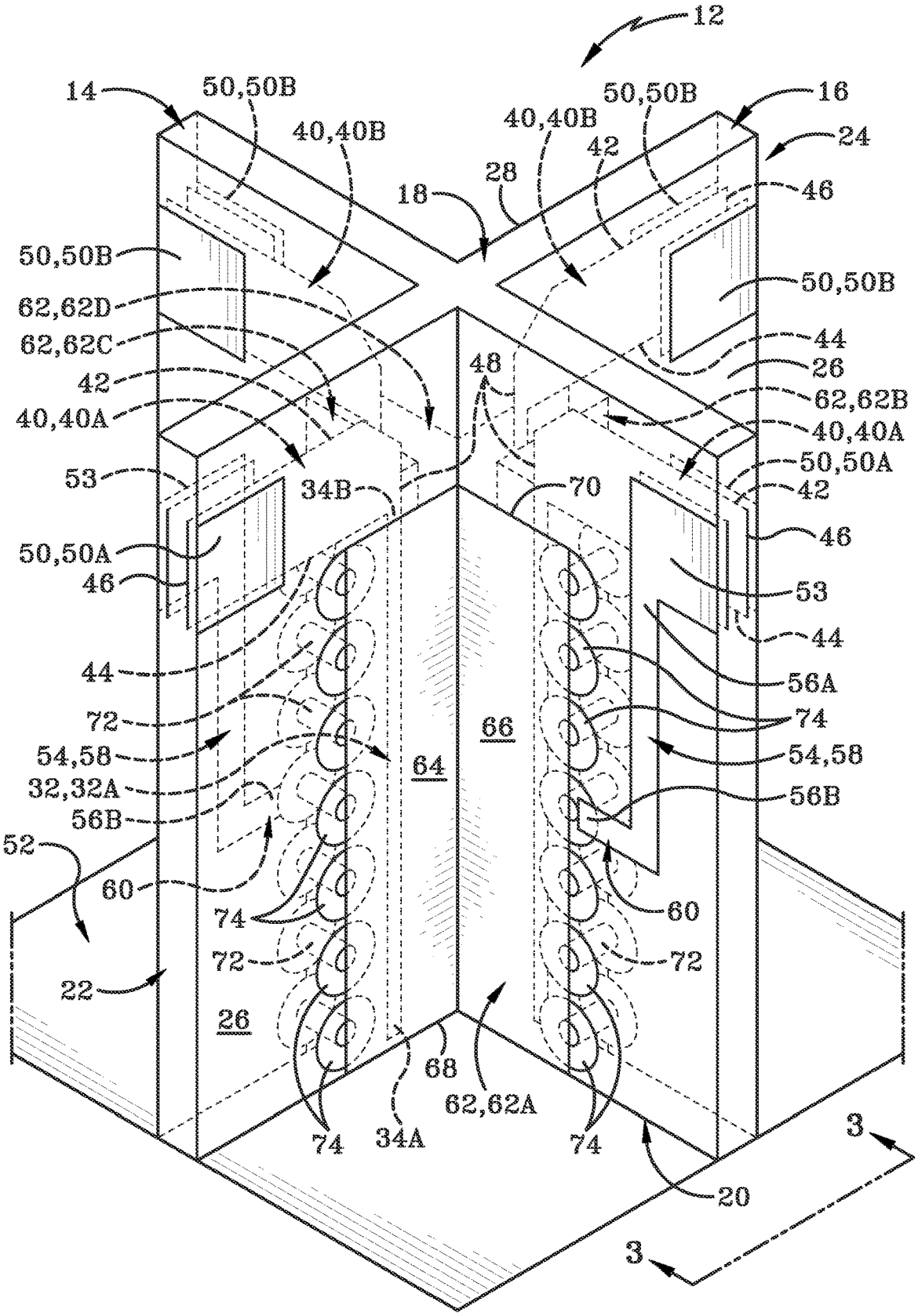
FIG. 2A is an enlarged top perspective view of an antenna unit cell of the tightly coupled dipole array in the region labeled "SEE FIG. 2A" in FIG. 1.
Figure 2B:
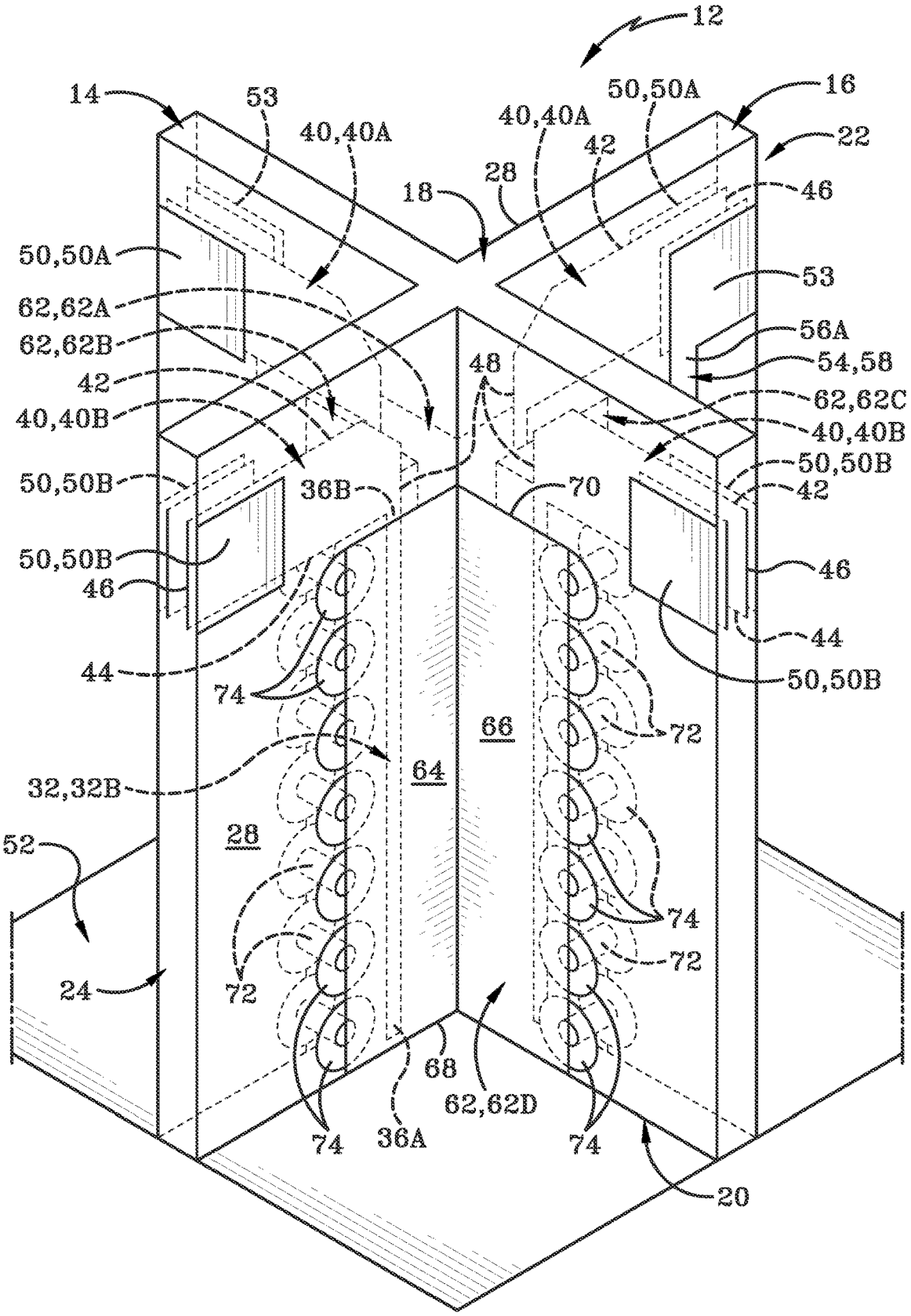
FIG. 2B is a rear top perspective view of the antenna unit cell depicted in FIG. 2A.

As depicted in FIG. 2A and FIG. 2B, the PCBs of each element 14, 16 intersect perpendicularly near their respective midlines to define a cross-shaped or X-shaped configuration of each respective unit cell 12.

Figure 3:
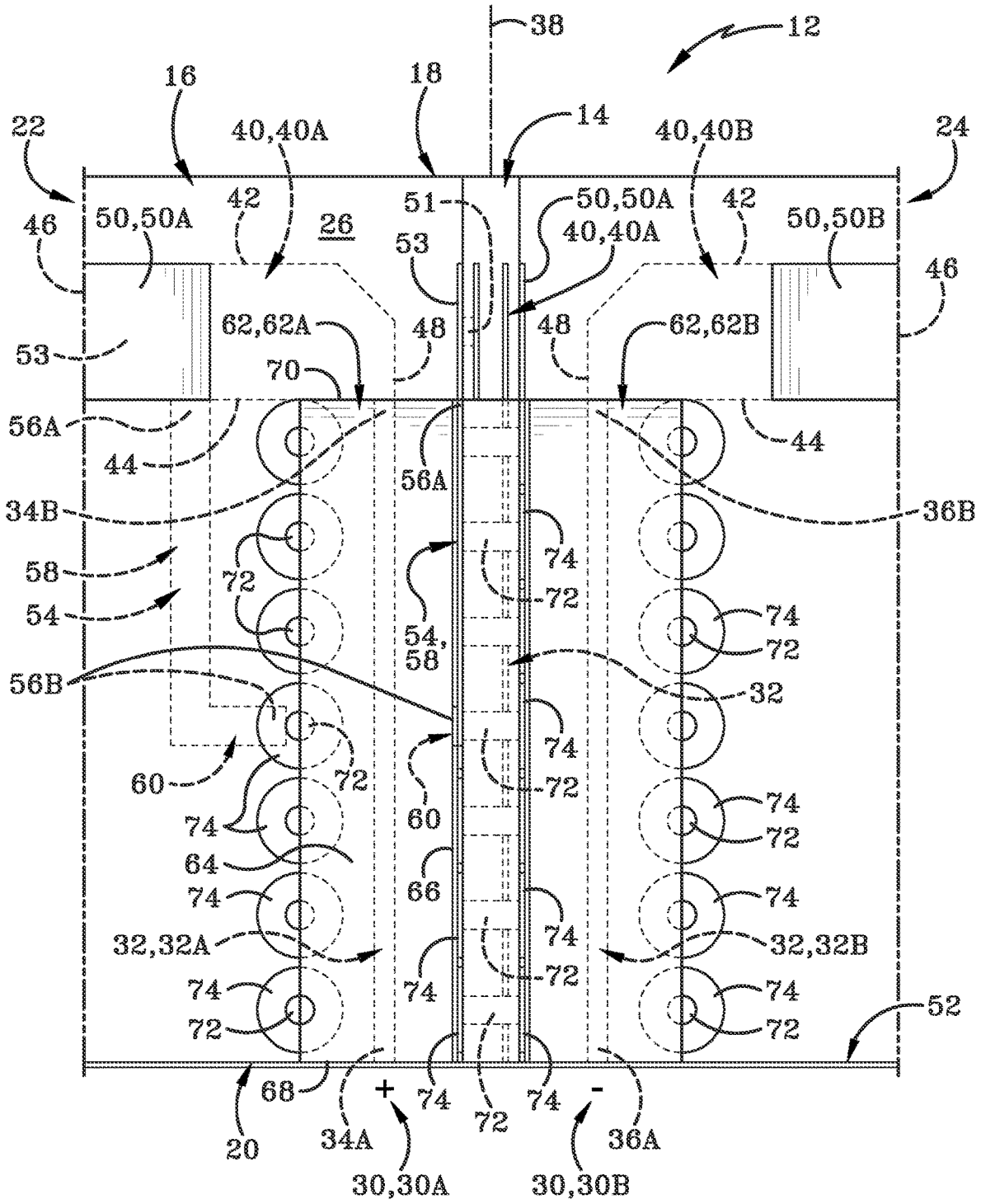
FIG. 3 is an elevation view the antenna unit cell taken along line 3-3 in FIG. 2A.

As depicted in FIG. 2A, FIG. 2B, and FIG. 3, the PCB of each respective element 14, 16 includes a plurality of conductors arranged in a configuration that enables and provides a balanced feed for each respective antenna element 14, 16 with integrated common mode rejection techniques that are adapted to extend the bandwidth of the aperture. The feeding structure of the conductors on each respective element 14, 16 is applied to phase-coincident dual-polarized (horizontal and vertical), offset dual-polarized apertures, or single-polarized apertures. The common mode rejection is accomplished through the use of a grounding or a shorting conductor as will be described in greater detail below, together with the balanced or differential feed lines.

Reference will be made to the printed circuit board and the conductors or conductive elements of each respective element. However, for brevity, the description herein is made with reference to the horizontally polarized element 16 depicted in the elevation view of FIG. 3; however, it is to be understood that the vertically polarized antenna element 14 has the same configuration with its physical structure being oriented 90 degrees orthogonal to that of the horizontally polarized element 16. The PCB of the antenna element includes a top end 18 and a bottom end 20 defining a vertical direction therebetween. The PCB of the polarized antenna element includes a first side 22 and a second side 24 defining a lateral direction therebetween. The edges of the first and second sides 22, 24 extend between the top 18 and the bottom 20. The PCB of the polarized element includes a first major surface 26 and an opposite second major surface 28 defining a transverse direction therebetween. The thickness of the PCB of the polarized antenna element is established in a line in the transverse direction extending between the first major surface and the second major surface of the PCB of the polarized antenna element. As is understood, the PCM of the polarized antenna element may be composed of a plurality of layers that collectively define the overall thickness between the first major surface and the second major surface.

FIG. 3 depicts that each polarized antenna element 14, 16 includes a differential feed input 30. The differential feed input 30 is located near the bottom 20 of the substrate of the PCB of each respective polarized antenna element. However, in other examples, different locations for the differential feed input 30 are entirely possible. Further, inasmuch as the feed input is a differential feed input, it is to be understood that the signals input into each of the terminals will be balanced but offset by a phase difference of about 180 degrees. The differential feed input 30 includes a positive terminal 30A and a negative terminal 30B. Each terminal 30A, 30B is adapted to receive the differential signal therethrough. More particularly, the positive terminal 30A is configured to receive the differential signal at a first phase and the negative terminal 30B is adapted to receive a second portion of the differential signal at a second phase that is different than the first phase. In one specific example, the second phase is 180 degrees different from the first phase.

The PCB of the polarized antenna element additionally includes a pair of twin transmission or feed lines 32. The pair of twin transmission or feed lines 32 are balanced feed lines that receive the differential signal and are fabricated from a conductive material, such as copper, to transmit signals there along. The pair of twin feed lines 32 include a first feed line 32A and a second feed line 32B. The first feed line 32A includes a first end 34A and a second end 34B. The second feed line 32B includes a first end 36A and a second end 36B. The first end 34A of the first feed line 32A is in electrical communication with the positive terminal 30A of the differential feed input 30. The first end 36A of the second feed line 32B is in electrical communication with the negative terminal 30B of the differential feed input 30. The twin feed lines 32 are formed from conductive material. In one particular embodiment, the twin feed lines 32 are parallel relative to each other and offset equally in a mirrored manner from a vertical center line 38. The respective first ends 34A, 36A of the first feed line 32A and the second feed line 32B may be disposed closely adjacent the bottom 20 of the PCB. However, it is entirely possible for the twin lines 32A, 32B to be oriented in a different configuration so long as the differential signal input into each of the respective twin feed lines 32 is balanced. For example, it is entirely possible for the inputs 30A, 30B to be respectively located on the first side 22 and second side 24 of the PCB. While FIG. 3 depicts that the pair of twin feed lines 32 are linear and straight, extending in a vertical manner from their respective first ends to their respective second ends, other configurations of the twin feed lines 32 may take differing shapes such that the entire length of each respective twin line is not linear.

The polarized antenna element may further include a pair of dipoles 40 including a first dipole 40A and a second dipole 40B. Each of the dipoles, namely first dipole 40A and second dipole 40B, include an upper edge 42 and a lower edge 44. Each dipole further includes an outer edge 46 and an inner edge 48. The inner edge 48 is located closer to the vertical center line 38 than the outer edge 46. In one particular embodiment, the outer edge 46 extends to and lies flush with the respective side edges of the PCB. With respect to the top and bottom edges 42, 44 of each respective dipole, the top edge 42 is located closer to the top 18 of the PCB than the lower edge 44. The top edge 42 lies below the top 18 of the PCB; however, it is entirely possible for the dipole to be located at various lengths offset from the top 18 of the PCB. The first dipole 40A and the second dipole 40B are formed from conductive materials and include major surfaces that are generally coplanar with the first major surface 26 of the PCB.

The first dipole 40A is in electrical communication with the first feed line 32A and the second dipole 40B is in electrical communication with the second feed line 32B.

In one particular embodiment, the second end 34B of the first feed line 32A is in electrical communication with the first dipole 40A adjacent the inner edge 48. However, other physical constructions are entirely possible. Additionally, in some embodiments, the first feed line 32A and the first dipole 40A may be located on the same layer of the PCB; however, it is not required. For example, the first feed line 32A and the first dipole 40A may be located on different layers of the PCB forming the polarized antenna element and the second end 34B of the first feed line 32A, connected with the first dipole 40A by way of a micro-via. Similarly, the second end 36B of the second feed line 32B is in electrical communication with the second dipole 40B adjacent its inner edge 48. This connection may be accomplished on one layer of the PCB or on different layers of the PCB by way of a micro-via as previously described with respect to the first dipole 40A and the first feed line 32A.

Near the outer edge 46 of each dipole, there may be a capacitance overlap element 50, namely, a first capacitance overlap 50A and a second capacitance overlap 50B that cover the first dipole 40A and the second dipole 40B, respectively. The capacitance overlaps 50 assist in making the antenna a TCDA.

The TCDA includes a common ground plane that is electrically connected to each of the unit cells 12. The ground plane 52 is an electrical ground that enables portion of the signal to be shorted thereto, as will be described in greater detail below. The common ground plane assists in eliminating common mode signals or common mode resonance in accordance with an aspect of the present disclosure.

A common mode mitigation element 54 is a conductive element or conductor that electrically couples the first dipole 40A to the common ground plane 52. The common mode mitigation element 54 is adapted to short the differential signal from the first dipole 40A to the common ground plane 52 to mitigate common mode in the antenna unit cell 12. In one example, the common mode mitigation element has a first end 56A and a second end 56B. The first end 56A of the common mode mitigation element 54 is in electrical communication with the first dipole 40A and the second end 56A of the common mode mitigation element 54 is electrically coupled with the ground plane 52. In one particular embodiment, the first end 56A of the common mode mitigation element 54 is electrically coupled near the lower edge 44 of the first dipole 40A. The common mode mitigation element 54 may be formed on the same layer as the first dipole 40A on the PCB. In this example, the first end 56A would be directly connected with the lower edge 44 of the first dipole 40A. However, it is also possible for the common mode mitigation element 54 to be formed on a different layer of the PCB and in this instance, then the first end 56A of the common mode mitigation element 54A would be coupled with the first dipole arm 40A by way of a micro-via 51. When utilizing micro-via 51 to install element 54 on a different layer of the PCB, as shown in FIG. 2A, FIG. 2B, and FIG. 3, the micro-via 51 may be connected with a widened portion 53 of the element 54 which is disposed in a similar footprint area, but different layer of the PCB, as the overlap 50A. Regardless of which layer the common mode mitigation element 54 is formed on the PCB, the common mode mitigation element 54 is electrically connected with the first dipole 40A.

In one example, the majority of the common mode mitigation element 54 may be formed as an L-shaped conductor on one layer of the PCB of the polarized antenna element. However, it is clearly understood that other shapes (such as S-shaped, C-shaped, or any other configuration) are entirely possible provided that the common mode mitigation element 54 electrically couples the first dipole 40A to the common ground plane 52 in order to short the common mode resonance during operation of the TCDA 10. This exemplary common mode mitigation element 54 may include a first leg 58 and a second leg 60. The first leg 58 may define a first conductive line that defines the first end 56A that is disposed below the first dipole 40A. The second leg 60 may define a second conductive line defining the second end 56B that is also disposed below the first dipole 40A. Because this particular configuration is an L-shaped common mode mitigation element 54, the second leg 56B is physically oriented orthogonal to the first leg 58. Stated otherwise, the first conductive line defined by the first leg 58 is in electrical communication with and physically oriented orthogonal to the second leg 60, defining the second conductive line.

With continued reference to FIG. 2A, FIG. 2B, and FIG. 3, each unit cell 12 may include at least one feed shield 62. The at least one feed shield 62 is configured to shield one of the twin feed lines 32. In one specific example, when the unit cell 12 is formed from two orthogonally intersected PCBs, namely, the vertically polarized antenna element 14 and the horizontally polarized antenna element 16, there may be four feed shields that shield the respective pair of twin lines 32 in each of the antenna elements. In this particular example, there may be a first feed shield 62A, a second feed shield 62B, a third feed shield 62C, and a fourth feed shield 62D. The four feed shields 62A-62D are each located in a respective quadrant of space wherein each quadrant is defined and bound by the intersected PCBs of the polarized antenna elements 14, 16. With this particular example, each of the feed shields 62A-62D are defined and shaped in an angular orientation similar to that of a 90 degree bracket. The shape of each feed shield includes a first wall 64 intersected perpendicularly with a second wall 66. The feed shield includes a lower edge 68 and an upper edge 70. The first wall 64 of the feed shield 62A is coupled with the first major surface 26 of antenna element 16 and the second wall 66 of the feed shield 62 is coupled with the second major surface of antenna element 14. With respect to the second feed shield 62B, the first wall of second feed shield 62B is coupled with the first major surface 26 of antenna element 16 and the second wall of second feed shield 62B is coupled with the first major surface of the antenna element 14. With respect to the third feed shield 62C, the first wall of the third feed shield 62C is coupled with the second major surface 28 of antenna element 16 and the second wall of the third feed shield 62C is coupled with the first major surface of antenna element 14. With respect to the fourth feed shield 62D, the first wall of fourth feed shield 62D is coupled with the second major surface 28 of antenna element 14 and the second wall of fourth feed shield 62D is coupled with the first major surface of antenna element 16.

The lower end of the at least one feed shield 62 may be coupled with the ground plane 52. The at least one feed shield 62 may be formed from a conductive material such that it is possible to use the feed shield to couple the common mode mitigation element to the common ground plane 52 by way of the at least one feed shield 62. Particularly, the second end 56B of the common mode mitigation element 54 may be directly or indirectly coupled to the at least one feed shield 62 in order to create an electrical connection from the common mode mitigation element 54 to the common ground plane 52. In one particular embodiment, the second end 56B of the common mode mitigation element may be directly connected with the at least one feed shield 62.

In another particular embodiment, specifically as shown in FIG. 3, the second end 56B of the common mode mitigation element 54 is indirectly coupled to the at least one feed shield 62 by way of one or more through-hole vias 72 that extend transversely through the PCB of the antenna element from the first major surface 26 to the second major surface 28. In the shown embodiment, there may be a plurality of through-hole vias 72 that are arranged in a vertical configuration and linearly aligned from adjacent the bottom 20 of the PCB towards the first dipole 40A. While the number of vias 72 may vary depending on application-specific needs, the shown embodiment depicts seven through-hole vias 72 extending transversely through the PCB on each side of the centerline (fourteen total) from the first major surface 26 to the second major surface 28. The vias 72 are linearly aligned and positioned laterally outward from the vertical center line 38 from the first feed line 32A. Stated otherwise, the vias 72 are located closer to the first side 22 of the PCB than the first feed line 32A. Each of the vias may be surrounded by a conductive pad 74. Each conductive pad 74 may be formed as a substantially annular member having an inner circular edge that is sized and shaped complementary to that of an outer surface of the through-hole via 72. The conductive pad may further include an outer circumferential or circular edge having a larger radius than that of the inner edge. In one particular embodiment, the conductive pads are formed on the outermost layer of the PCB defining the antenna element. While the through-hole via 72 extends fully transversely through the PCB, the conductive pad 74 resides primarily on, in, or closely adjacent the outermost layer of the PCB defining the first major surface 26. Additionally, another conductive pad may be formed opposite on the second major surface 28 at, in, or closely adjacent the outermost layer thereof.

Figure 4:
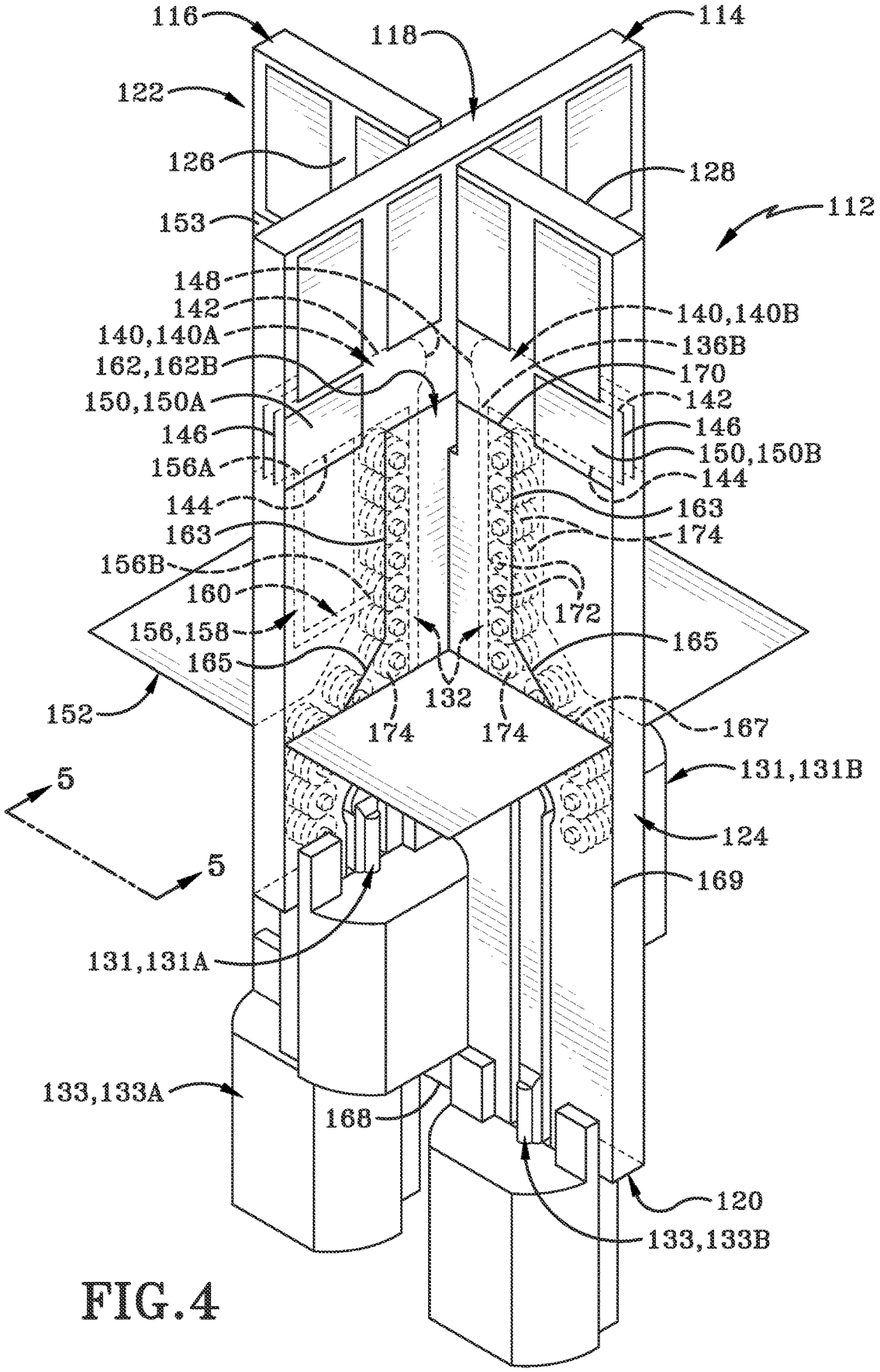
FIG. 4 is an enlarged top perspective view of a second embodiment antenna unit cell of the tightly coupled dipole array.
Figure 5:
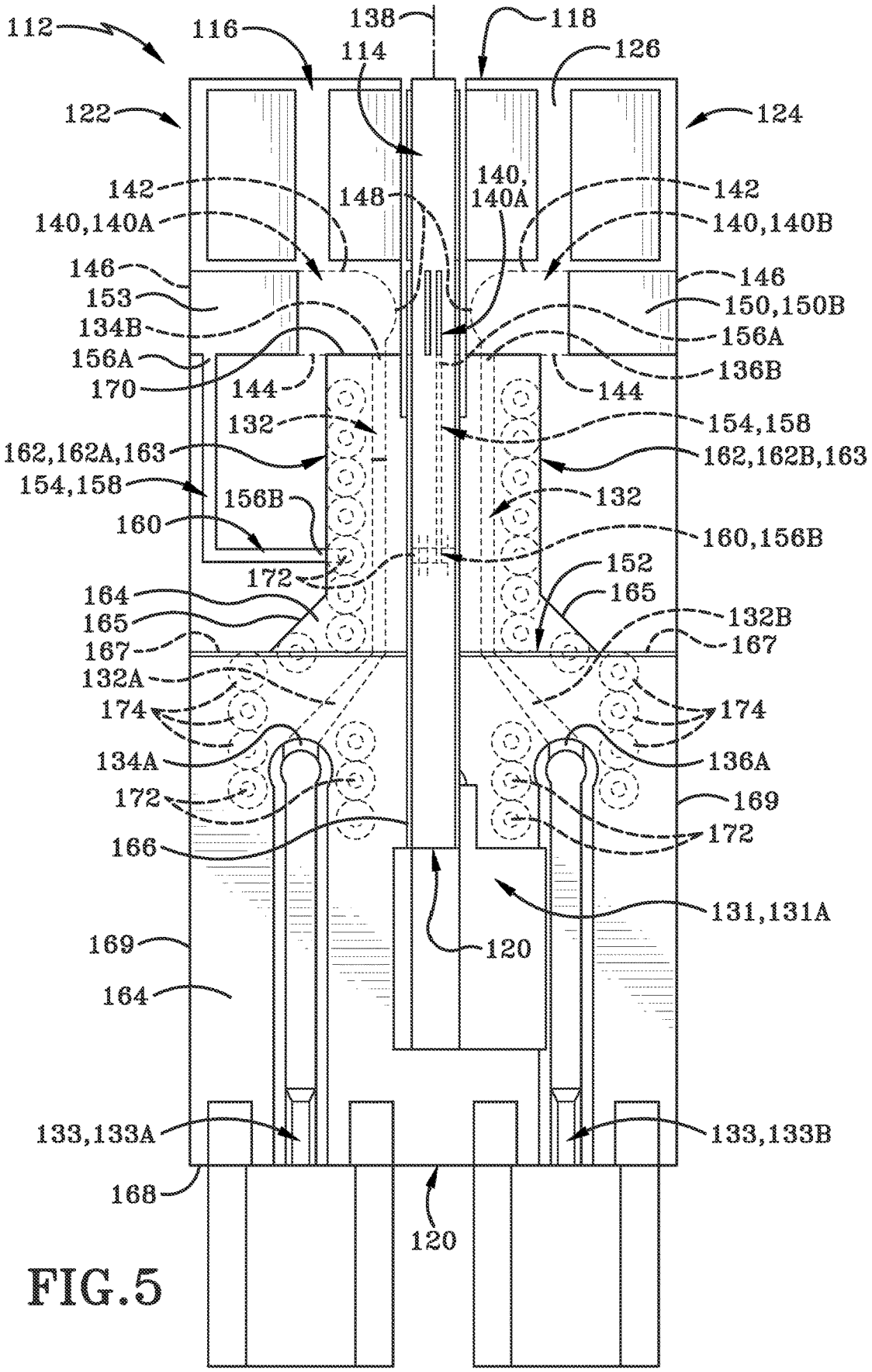
FIG. 5 is an elevation view the second embodiment antenna unit cell taken along line 4-4 in FIG. 4.

FIG. 4 and FIG. 5 depict another embodiment of an antenna unit cell 112 that may be used in TCDA. As depicted in FIG. 2, the PCBs of each element 114, 116 intersect perpendicularly near their respective midlines to define a cross-shaped or X-shaped configuration of each respective unit cell 112.

As depicted in FIG. 4 and FIG. 5, the PCB of each respective element 114, 116 includes a plurality of conductors arranged in a configuration that enables and provides a balanced feed for each respective antenna element 114, 116 with integrated common mode rejection techniques that are adapted to extend the bandwidth of the aperture. The feeding structure of the conductors on each respective element 114, 116 is applied to phase-coincident dual-polarized (horizontal and vertical), offset dual-polarized apertures, or single-polarized apertures. The common mode rejection is accomplished through the use of a grounding or a shorting conductor as will be described in greater detail below, together with the balanced or differential feed lines.

Reference will be made to the printed circuit board and the conductors or conductive elements of each respective element 114, 116. However, for brevity, the description herein is made with reference to the horizontally polarized element 116 depicted in the elevation view of FIG. 5; however, it is to be understood that the vertically polarized antenna element 114 has the same configuration with its physical structure being oriented 90 degrees orthogonal to that of the horizontally polarized element 116. The PCB of the antenna element includes a top end 118 and a bottom end 120 defining a vertical direction therebetween. The PCB of the polarized antenna element includes a first side 122 and a second side 124 defining a lateral direction therebetween. The edges of the first and second sides 122, 124 extend between the top 118 and the bottom 120. The PCB of the polarized element includes a first major surface 126 and an opposite second major surface 128 defining a transverse direction therebetween. The thickness of the PCB of the polarized antenna element is established in a line in the transverse direction extending between the first major surface 126 and the second major surface 128 of the PCB of the polarized antenna element. As is understood, the PCM of the polarized antenna element may be composed of a plurality of layers that collectively define the overall thickness between the first major surface and the second major surface.

FIG. 4 depicts that each polarized antenna element 114, 116 includes a differential feed input. The differential feed input is located near the bottom 120 of the substrate of the PCB of each respective polarized antenna element. However, in this example, the differential feed inputs for each polarized antenna element 114, 116 is a different height relative to the vertical direction the PCB of the antenna element. For example, the vertically polarized antenna element 114 may include a differential input 131 having a positive terminal 131A and a negative terminal 131B. The horizontally polarized antenna element 116 may include a differential input 133 having a positive terminal 133A and a negative terminal 133B. The differential input 131 is a different height than the differential input 133. The different or offset heights of the differential inputs allows for active feed for both polarizations of the antenna elements 114, 116. In one specific example, the differential input 131 is vertically above the differential input 133. However, different heights or locations for the differential feed inputs 131, 133 are entirely possible. Each terminal 131A, 131B and 133A, 133B is adapted to receive the differential signal therethrough. More particularly, the positive terminals 131A, 133A are configured to receive the differential signal at a first phase and the negative terminals 131B, 133B are adapted to receive a second portion of the differential signal at a second phase that is different than the first phase. In one specific example, the second phase is 180 degrees different from the first phase.

The PCB of the polarized antenna element additionally includes a pair of twin feed lines 132. The pair of twin feed lines 132 are balanced feed lines that receive the differential signal. The pair of twin feed lines 132 include a first feed line 132A and a second feed line 132B. The first feed line 132A includes a first end 134A and a second end 134B. The second feed line 132B includes a first end 136A and a second end 136B.

In this example, the first feed line 132A is composed of linear segments that are coupled together to form a continuous conductor that collectively define a configuration that places the first end 134A of the first feed line 132A closer to the first side 122 of the PCB than the second end of the first feed line 132A. Stated otherwise, the first feed line 132A has a slight bend or turn along its length such that the first end 134A of the first feed line 132A is disposed farther away from the vertical centerline 138 of the PCB than the second end 134B. Similarly, the second feed line 132B is composed of linear segments that are coupled together to form a continuous conductor that collectively define a configuration that places the first end 136A of the second feed line 132B closer to the second side 124 of the PCB than the second end 136B of the second feed line 132B. Stated otherwise, the second feed line 132B has a slight bend or turn along its length such that the first end 136A of the second feed line 132B is disposed farther away from the vertical centerline 138 of the PCB than the second end 136B.

The first end 134A of the first feed line 132A is in electrical communication with the positive terminal 133A of the differential feed input 133. The first end 136A of the second feed line 132B is in electrical communication with the negative terminal 133B of the differential feed input 133. The twin feed lines 132 are formed from conductive material. In one particular embodiment, the twin feed lines 132 have upper segments that are parallel relative to each other and offset equally in a mirrored manner from the vertical center line 38, and lower segments thereof that are angled laterally towards the sides of the PCB. The respective first ends 134A, 136A of the first feed line 132A and the second feed line 132B may be disposed vertically above the bottom 120 of the PCB and utilize other conductive lines to couple to the signal feeds to allow for the offset height of the feed to allow for active feeding in both polarizations.

Each polarized antenna element 114, 116 may further include a pair of dipoles 140 including a first dipole arm or first dipole 140A and a second dipole arm or second dipole 140B. Each of the dipoles, namely first dipole 140A and second dipole 140B, include an upper edge 142 and a lower edge 144. Each dipole further includes an outer edge 146 and an inner edge 148. The inner edge 148 is located closer to the vertical center line 138 than the outer edge 146. In one particular embodiment, the outer edge 146 extends to and lies flush with the respective side edges of the PCB. With respect to the top and bottom edges 142, 144 of each respective dipole, the top edge 142 is located closer to the top 118 of the PCB than the lower edge 144. The top edge 142 lies below the top 118 of the PCB; however, it is entirely possible for the dipole to be located at various lengths offset from the top 118 of the PCB. The first dipole 140A and the second dipole 140B are formed from conductive materials and include major surfaces that are generally coplanar with the first major surface 126 of the PCB.

The first dipole 140A is in electrical communication with the first feed line 132A and the second dipole 140B is in electrical communication with the second feed line 132B.

In one particular embodiment, the second end 134B of the first feed line 132A is in electrical communication with the first dipole 140A adjacent the inner edge 148. However, other physical constructions are entirely possible. Additionally, in some embodiments, the first feed line 132A and the first dipole 140A may be located on the same layer of the PCB; however, it is not required. For example, the first feed line 132A and the first dipole 140A may be located on different layers of the PCB forming the polarized antenna element and the second end 134B of the first feed line 132A, connected with the first dipole 140A by way of a micro-via. Similarly, the second end 136B of the second feed line 132B is in electrical communication with the second dipole 140B adjacent its inner edge 148. This connection may be accomplished on one layer of the PCB or on different layers of the PCB by way of a micro-via as previously described with respect to the first dipole 140A and the first feed line 132A.

Near the outer edge 146 of each dipole, there may be a capacitance overlap element 150, namely, a first capacitance overlap 150A and a second capacitance overlap 50B that cover the first dipole 140A and the second dipole 140B, respectively. The capacitance overlaps 150 assist in making the antenna a TCDA.

The TCDA formed from a plurality of unit cells 112, only one of which is depicted in FIG. 3 and FIG. 4, includes a common ground plane that is electrically connected to each of the unit cells 112. The ground plane 152 is an electrical ground that enables portion of the signal to be shorted thereto, as will be described in greater detail below. The common ground plane 152 assists in eliminating common mode or common mode resonance in accordance with an aspect of the present disclosure. In this particular instance, the ground plane is positioned vertically above the differential feed inputs 131, 133, however other locations are entirely possible, such as below the differential feed inputs 131, 133.

A common mode mitigation element 154 is a conductive element or conductor that electrically couples the first dipole 140A to the common ground plane 152. The common mode mitigation element 154 is adapted to short the differential signal from the first dipole 140A to the common ground plane 152 to mitigate common mode in the antenna unit cell 112. In one example, the common mode mitigation element has a first end 156A and a second end 156B. The first end 156A of the common mode mitigation element 154 is in electrical communication with the first dipole 140A and the second end 156A of the common mode mitigation element 154 is electrically coupled with the ground plane 152. In one particular embodiment, the first end 156A of the common mode mitigation element 154 is electrically coupled near the lower edge 144 of the first dipole 140A. The common mode mitigation element 154 may be formed on the same layer as the first dipole 140A on the PCB. When on the same layer of the PCB, the first end 156A would be directly connected with the lower edge 144 of the first dipole 140A. However, it is also possible for the common mode mitigation element 154 to be formed on a different layer of the PCB and in this instance, then the first end 156A of the common mode mitigation element 154 would be coupled with the first dipole arm 140A by way of a micro-via and could utilize an widened area. In the shown embodiment, the element 154 is connected to a first capacitance overlap 150A, which is one of a pair of capacitance overlaps 150 including a second capacitance overlap 150B. Regardless of which layer the common mode mitigation element 154 is formed on the PCB, the common mode mitigation element 154 is electrically connected with the first dipole 140A.

In one example, the common mode mitigation element 154 may be formed as an L-shaped conductor on one layer of the PCB of the polarized antenna element. However, it is clearly understood that other shapes are entirely possible provided that the common mode mitigation element 154 electrically couples the first dipole 140A to the common ground plane 152 in order to short the common mode resonance during operation of the TCDA. This exemplary common mode mitigation element 154 may include a first leg 158 and a second leg 160. The first leg 158 may define a first conductive line that defines the first end 156A that is disposed below the first dipole 140A. The second leg 160 may define a second conductive line defining the second end 156B that is also disposed below the first dipole 140A. Because this particular configuration is an L-shaped common mode mitigation element 154, the second leg 156B is physically oriented orthogonal to the first leg 158. Stated otherwise, the first conductive line defined by the first leg 158 is in electrical communication with and physically oriented orthogonal to the second leg 160, defining the second conductive line.

With continued reference to FIG. 4 and FIG. 5, each unit cell 112 may include at least one feed shield 162. The at least one feed shield 162 is configured to shield one of the twin feed lines 132. In one specific example, when the unit cell 112 is formed from two orthogonally intersected PCBs, namely, the vertically polarized antenna element 114 and the horizontally polarized antenna element 116, there may be four feed shields that shield the respective pair of twin lines 132 in each of the antenna elements. In this particular example, there may be a first feed shield 162A, a second feed shield 162B, a third feed shield (not shown as it is on the opposite side than what is viewable in FIG. 4), and a fourth feed shield (not shown as it is on the opposite side than what is viewable in FIG. 4). The four feed shields 162 are each located in a respective quadrant of space wherein each quadrant is defined and bound by the intersected PCBs of the polarized antenna elements 14, 16. With this particular example, each of the feed shields 162 are defined and shaped in an angular orientation similar to that of a 90 degree bracket.

The shape of each feed shield 162 includes a first wall 164 intersected perpendicularly with a second wall 166. The feed shield includes a lower edge 168 and an upper edge 170. Each feed shield may defined an outer edge collectively defined by linear segments that are angled relative to each other such that the outer edge of the feed shield 162 angles outward and away from the center line 138. In one specific example, the outer edge of first wall 164 on feed shield 162 may be defined by an upper vertical edge portion 163, an angled edge portion 165, a lateral edge portion 167, and a lower vertical edge portion 169. This configuration places the lower vertical edge portion 169 substantially coplanar with the first side 122 of the PCB and farther from the vertical center line 138 than the vertical upper portion 163.

The first wall 164 of the feed shield 62A is coupled with the first major surface 126 of antenna element 116 and the second wall 166 of the feed shield 62 is coupled with the second major surface of antenna element 114. With respect to the second feed shield 162B, the first wall of second feed shield 162B is coupled with the first major surface 26 of antenna element 116 and the second wall of second feed shield 162B is coupled with the first major surface of the antenna element 114. With respect to the third feed shield, the first wall of the third feed shield is coupled with the second major surface 128 of antenna element 116 and the second wall of the third feed shield is coupled with the first major surface of antenna element 114. With respect to the fourth feed shield, the first wall of fourth feed shield is coupled with the second major surface of antenna element 114 and the second wall of fourth feed shield is coupled with the first major surface of antenna element 116.

The at least one feed shield 162 may be coupled with the ground plane 152. The at least one feed shield 162 may be formed from a conductive material such that it is possible to use the feed shield to couple the common mode mitigation element 154 to the common ground plane 152 by way of the at least one feed shield 162. Particularly, the second end 156B of the common mode mitigation element 154 may be directly or indirectly coupled to the at least one feed shield 162 in order to create an electrical connection from the common mode mitigation element 154 to the common ground plane 152. In one particular embodiment, the second end 156B of the common mode mitigation element may be directly connected with the at least one feed shield 162.

In another particular embodiment, specifically as shown in FIG. 5, the second end 156B of the common mode mitigation element 154 is indirectly coupled to the at least one feed shield 162 by way of one or more through-hole vias 172 that extend transversely through the PCB of the antenna element from the first major surface 26 to the second major surface 28. In the shown embodiment, there may be a plurality of through-hole vias 172 that are arranged in a vertical configuration and linearly aligned from adjacent the first end 134A of the feed line 132A towards the first dipole 140A. While the number of vias 172 may vary depending on application-specific needs, the shown embodiment depicts fifteen through-hole vias 172 on each side of the center line 138 (thirty total) extending transversely through the PCB from the first major surface 26 to the second major surface 28. Each of the vias may be surrounded by a conductive pad. Each conductive pad may be formed as a substantially annular member having an inner circular edge that is sized and shaped complementary to that of an outer surface of the through-hole via 172. The conductive pad may further include an outer circumferential or circular edge having a larger radius than that of the inner edge. In one particular embodiment, the conductive pads are formed on the outermost layer of the PCB defining the antenna element. While the through-hole via 172 extends fully transversely through the PCB, the conductive pad resides primarily on, in, or closely adjacent the outermost layer of the PCB defining the first major surface 26. Additionally, another conductive pad may be formed opposite on the second major surface 28 at, in, or closely adjacent the outermost layer thereof.

Further, FIGS. 1-5 show one concept of this present disclosure in which the shown is feed 'concentric' where the vertical and horizontal PCBs or cards intersect at the feed center. However, the present disclosure is also applicable to feed 'offset' where the vertical and horizontal PCBs or cards intersect at the dipole edges.

Having thus described the structural configuration of various embodiments of the present disclosure. Reference will now be made to its advantages and operation to reduce common mode.

In operation, and as shown in FIG. 3, each unit cell 12 has orthogonally-aligned printed circuit boards. Namely, a horizontal polarized antenna element 16 and a vertically polarized antenna element 14. The printed circuit boards each carry simple twin balanced feed lines 32 that are connected to dipoles 40 or a pair of arms (i.e., first dipole arm 40A and second dipole arm 40B). In one particular embodiment, each unit cell 12 is connected to a plurality of adjacent unit cells to define an egg crate pattern for the overall antenna array.

Each antenna element 14, 16 includes the antenna input. The antenna input 30 has a positive terminal 30A and a negative terminal 30B. The positive terminal 30A and the negative terminal 30B each receive signals from an input source that are 180 degrees in phase. Operatively, a signal travels up the first feed line 32A and then travels down the second feed line 32B. The signal input to the input terminals 30A, 30B is an analog signal. In one particular embodiment, the signal is an analog radio frequency (RF) signal.

The simple twin feed line is composed of the first feed line 32A and the second feed line 32B. The lower or first end 34A of the first feed line 32A is coupled with the positive input terminal 30A and the lower end or first end 36A of the second feed line 32B is coupled with the negative input terminal 30B. Each respective twin feed line is on the printed circuit board located between the feed shields 62. The feed shields 62 are angled elements formed of two connected planar segments 64, 66 to define a 90 degree angle therebetween. The feed shield 62 is also a brace that couples or braces the vertically polarized antenna element 14 to the horizontally polarized antenna element 16. The upper or second end 34B of the first feed line 32A is connected with the first dipole 40A arm and the upper or second end 36B of the second feed line 32B is connected with the second dipole 40B arm. On each dipole 40 is capacitance overlaps 50. The capacitance overlaps enable the tightly coupled function of the TCDA 10.

In operation and with continued reference to FIG. 3, there is a common mode mitigation element 54 that is configured to short part of the signal moving through the first dipole 40A. The first end 56A of the element 54 is connected to the first dipole 40A and the second end 56B is directly or indirectly coupled to the ground plane 52. In one particular embodiment, the element 54 is generally L-shaped, having a long vertical first leg and a short horizontal second leg. However, any configuration that grounds the first dipole 40A to the common ground plane 52 will suffice. In the specific example of FIG. 3, the second end of the element that is defined by the second short horizontal leg is connected to a conductive element extending through the printed circuit board. In this particular example, the conductive element is a conductive via 72 that is conductively connected with the ground plane 52 of the unit cell. More particularly, the conductive via 72 is conductively coupled with the feed shield which is directly connected with the ground plane of the unit cell. Thus, signal travels from the positive input terminal 30A through the first feed line 32A to the first dipole 40A. The signal will then be shorted to ground 52 via the element 54 by traveling along the first vertical leg 56A and then to the horizontal second leg 56B into the conductive via 72 and then into the feed shield 62 which is connected to the ground plane 52. By shorting the common mode from the dipole 40A into the ground plane 52, this is able to eliminate the common mode from the dipole 40A by shorting the common mode into the ground plane 52. This shorting of the common mode does not affect the signal because the signals are not affected by the shielding provided by the feed shield. Particularly, the feed shields effectuate the shielding of the signal from everything else.

Each through-hole via that is formed from a conductive material, such as copper, may have a pad that is formed on one of the layers of the printed circuit board. The pads may, but are not required, to extend entirely through the printed circuit boards like the through-hole vias that do extend from the first major surface to the second major surface of the printed circuit board.

By way of additional background, the difference between the PUMA array and the present disclosure include the egg-crate design of the present disclosure, as seen in FIG. 1. The egg crate design of the TCDA present disclosure provides significantly more air eroding. This allows the antenna of the present disclosure to have lower dielectrics. By including a significant amount of air in the antenna of the present disclosure, it allows greater bandwidth to be achieved. The PUMA does not include this feature. Contrary to this, the PUMA array is built like a multiple layer configuration with holes drilled therethrough. Because of its configuration, the PUMA array can only achieve a 3 to 1 ratio from frequency high to frequency low, whereas the configuration of the present disclosure is able to achieve a 9 to 1 ratio from frequency high to frequency low. Another distinction between the present disclosure and the PUMA array is that the present disclosure antenna uses differential feeds with one of the dipoles being shorted to the ground plane. This is in distinction to the PUMA array that uses a single input feed with a balun.

Figure 6:
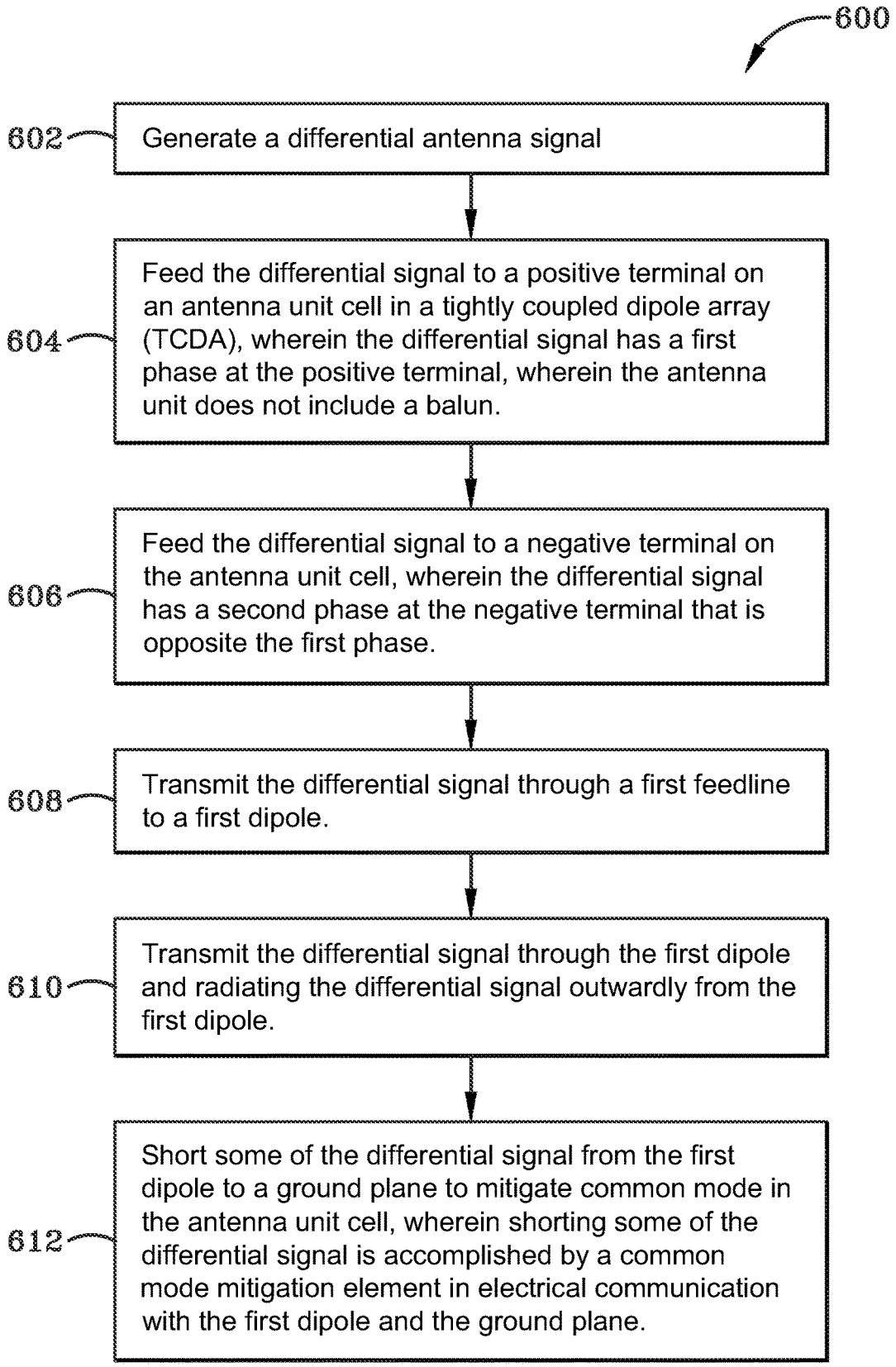
FIG. 6 is a flow chart depicting an exemplary method of the present disclosure.

FIG. 6 depicts an exemplary method of the present disclosure generally at 600. Method 600 includes generating a differential antenna signal, shown generally at 602. Method 600 includes feeding the differential signal to a positive terminal on an antenna unit cell in a tightly coupled dipole array (TCDA), wherein the differential signal has a first phase, wherein the antenna unit does not include a balun, shown generally at 604. Method 600 includes feeding the differential signal to a negative terminal on the antenna unit cell, wherein the differential signal at the negative terminal has a second phase that is opposite the first phase, shown generally at 606, and in one particular example is 180° opposite. Method 600 includes transmitting the differential signal through a first feedline to a first dipole, show generally at 608. Method 600 includes transmitting the differential signal through the first dipole and radiating some of the differential signal outwardly from the first dipole, generally at 610. Method 600 includes shorting some of (i.e., a portion of) the differential signal from the first dipole to a ground plane to mitigate common mode in the antenna unit cell, wherein shorting some of the differential signal is accomplished by a common mode mitigation element in electrical communication with the first dipole and the ground plane, shown generally at 612.

Method 600 may further include transmitting shorted portion of the differential signal through a first conductive line of the common mode mitigation element, wherein at least a portion of the first conductive line is disposed below the first dipole; and transmitting the shorted portion of the differential signal through a second conductive line of the common mode mitigation element that is disposed below the first dipole. Additionally, method 600 may include transmitting the shorted portion the differential signal from the common mode mitigation element to a first feed shield formed from conductive material that is in electrical communication with the common ground plane, wherein the feed shield is coupled to a major outer surface of a substrate of the antenna unit cell. Further, method 600 may include transmitting the shorted portion of the differential signal from the common mode mitigation element to at least one shielding via formed from a conductive material that is in electrical communication with the feed shield and the at least one shielding via extends transversely through the substrate, wherein the common mode mitigation element is in electrical communication with the at least one shielding via. Method 600 results in the TCDA being differential egg-crate TCDA and an at least 9:1 Bandwidth ratio.

As described herein, mitigating the common mode signal refers to reducing or eliminating common mode signals in the TCDA when no balun is present but differential signals are input into the TCDA. Mitigating the common mode signal from the differential input signals without the balun enables the TCDA to operate with reduced noise or essentially no noise and may ensure electromagnetic capability. This technique conforms with that which is know that Unless the intention is to transmit or receive radio signals, an electronic designer generally designs electronic circuits to minimise or eliminate common-mode effects and the TCDA and method thereof described herein is design to accomplish the same.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented in conjunction with hardware, software, or a combination thereof. When implemented in conjunction with software, the software code or instructions can be executed on any suitable processor or collection of processors to operate the TCDA, whether provided in a single computer or distributed among multiple computers. Furthermore, the instructions or software code can be stored in at least one non-transitory computer readable storage medium.

Also, a computer or smartphone utilized to execute the software code or instructions via its processors for operating the TCDA may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that operate the TCDA that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts for operating the TCDA may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology relating the TCDA operations that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. An antenna unit cell comprising:

a differential feed input comprising a positive terminal and a negative terminal, wherein the positive terminal and the negative terminal are adapted to receive a differential signal;

a first feed line having a first end and a second end;

a second feed line having a first end and a second end, wherein the first feed line and the second feed line define a pair of differential feed lines;

the first end of the first feed line in electrical communication with the positive terminal;

the first end of the second feed line in electrical communication with the negative terminal;

a first dipole arm and a second dipole arm;

the second end of the first feed line in electrical communication with the first dipole arm and the second end of the second feed line in electrical communication with the second dipole arm;

a common ground plane;

a common mode mitigation element having a first end and a second end, and the first end of the common mode mitigation element in electrical communication with the first dipole arm and the second end of the common mode mitigation element in electrical communication with the common ground plane, wherein the common mode mitigation element is adapted to short a portion of the differential signal from the first dipole arm to the common ground plane to mitigate common mode signal in the antenna unit cell, wherein the common mode mitigation element includes:

a first conductive line defining the first end of the common mode mitigation element, wherein at least a portion of the first conductive line is distanced from the first dipole arm;

a second conductive line defining the second end of the common mode mitigation element that is disposed below the first dipole arm, wherein the first conductive line is in electrical communication with the second conductive line, and further comprising:

a first feed shield formed from a conductive material that is in electrical communication with the common ground plane, wherein the second end of the common mode mitigation element is in electrical communication with the feed shield;

a substrate having a major outer first surface and a major outer second surface opposite the major outer first surface, wherein the feed shield is coupled to the major outer first surface; and at least one shielding via formed from a conductive material that is in electrical communication with the feed shield and the at least one shielding via extends through the substrate from the major outer first surface to the major outer second surface, wherein the second end of the common mode mitigation element is in electrical communication with the at least one shielding via.

2. The antenna unit cell of claim 1, wherein the first conductive line is in electrical communication with and physically oriented orthogonal to the second conductive line.

3. The antenna unit cell of claim 1, further comprising:

a plurality of shielding vias formed from conductive material that is in electrical communication with the feed shield, wherein the at least one shielding via is one of the plurality of shielding vias, wherein the plurality of shield vias are linearly aligned in vertical orientation relative to the substrate.

4. The antenna unit cell of claim 3, further comprising:

a second feed shield formed from conductive material that is disposed on an opposite side of the substrate from the first feed shield, wherein second feed shield is in electrical communication with the ground plane and the plurality of shielding vias are in electrical communication with the second feed shield.

5. The antenna unit cell of claim 1, further comprising:

a shielding pad formed from conductive material in electrical communication with the at least one shielding via.

6. The antenna unit of claim 5, further comprising:

wherein the shielding pad surrounds a portion of the at least one shielding via.

7. The antenna unit of claim 6, further comprising:

an inner edge of the shielding pad having a configuration that is complementary to an outer surface of the at least one shielding via, wherein the shielding pad circumscribes the at least one shielding via.

8. The antenna unit cell of claim 7, wherein the shielding pad is disposed in the first surface of the substrate.

9. The antenna unit cell of claim 8, wherein the shielding pad is in electrical communication with the first feed shield that is connected to the first surface of the substrate.

10. The antenna unit cell of claim 9, further comprising:

a first portion of the first feed shield;

a second portion of the first feed shield;

wherein the second portion of the first feed shield is orthogonal to the first portion of the first feed shield;

wherein first portion of the first feed shield directly abuts the first surface of the substrate and the second portion of the first feed shield is adapted to directly abut a second substrate carrying a second common mode mitigation element in electrical communication with the common ground plane.

* * * * *